United States Patent [19]

Anderka

[11] 4,356,632

[45] Nov. 2, 1982

[54] WRITING APPARATUS

[75] Inventor: Gerold Anderka, Holsteinner Chaussee, Fed. Rep. of Germany

[73] Assignee: Koh-I-Noor Rapidograph, Inc., Bloomsbury, N.J.

[21] Appl. No.: 154,163

[22] Filed: May 28, 1980

[30] Foreign Application Priority Data

Sep. 6, 1979 [DE] Fed. Rep. of Germany ..... 2923499

[51] Int. Cl.[3] ..... B43L 13/02

[52] U.S. Cl. ..... 33/18 R; 33/430; 33/1 M

[58] Field of Search ..... 33/1 M, 18 R, 18 B, 33/23 C, 430, 438

[56] References Cited

U.S. PATENT DOCUMENTS

| | | | |
|---|---|---|---|
| 3,293,651 | 12/1966 | Gerber et al. | 346/29 |
| 3,325,902 | 6/1967 | Schuman | 33/18 B |
| 3,349,176 | 10/1967 | Ascoli . | |
| 3,413,648 | 11/1968 | Martsolf | 33/1 M X |
| 3,422,538 | 1/1969 | Panissidi | 33/26 |
| 3,473,009 | 10/1969 | Gerber et al. | 235/151 |
| 3,613,248 | 10/1971 | McInnis | 33/18 R |
| 3,696,388 | 12/1970 | Eichelberger | 340/324 A |
| 3,702,922 | 11/1972 | Hall | 235/61.6 |
| 3,763,479 | 10/1973 | Jebb et al. | 364/520 |
| 3,900,853 | 8/1975 | White | 346/139 R |
| 3,968,498 | 7/1976 | Uchiyama | 346/29 |
| 3,982,165 | 9/1976 | Rich | 318/568 |
| 4,135,303 | 1/1979 | Gresset | 33/18 B |
| 4,150,902 | 9/1979 | Brescia | 400/17 |
| 4,171,657 | 10/1979 | Halberschmidt et al. | 33/1 M X |
| 4,176,455 | 12/1979 | Copeland et al. | 33/1 M |
| 4,197,550 | 4/1980 | Held | 33/18 R X |
| 4,254,552 | 3/1981 | Samis | 33/18 R |
| 4,277,893 | 7/1981 | Munther | 33/18 R |

FOREIGN PATENT DOCUMENTS

| | | |
|---|---|---|
| 1211802 | 3/1966 | Fed. Rep. of Germany . |
| 1241312 | 11/1967 | Fed. Rep. of Germany . |
| 1295858 | 5/1969 | Fed. Rep. of Germany . |
| 1486927 | 3/1972 | Fed. Rep. of Germany . |
| 2452393 | 5/1976 | Fed. Rep. of Germany . |
| 2724855 | 12/1978 | Fed. Rep. of Germany . |
| 1366253 | 9/1974 | United Kingdom . |

OTHER PUBLICATIONS

Datascribe II Brochure, Alpha Merics, Van Nuys, Ca. 91406, 5/79.

*Primary Examiner*—Charles E. Phillips

*Attorney, Agent, or Firm*—David H. Semmes; Warren E. Olsen

[57] ABSTRACT

A lettering device of the type having a keyboard for choosing the symbols to be written, comprising a writing part, which may be separated from said keyboard, wherein the pen is selectively moved by two geared motors, in two coordinate directions, to correspond to the symbols to be drawn. The writing part is adapted to be attached to the symbol head of a drafting machine, wherein two motors, that selectively move the writing pen along cartesian coordinates, are arranged stationary, relative to each other. The writing arm which holds the writing pen is movable, in the one coordinate direction, upon a first movable guide track that itself is movable in the other coordinate direction by a first motor, and also movable in the other coordinate direction upon a second guide track, that is movable in the direction of said one coordinate by a second motor.

6 Claims, 2 Drawing Figures

WRITING APPARATUS

BACKGROUND OF THE INVENTION:

1. Field of the Invention:

The invention concerns a lettering device with a keyboard for choosing the symbols to be written and a special part which can be separated from the bank of keys if necessary which exhibits a writing pen which can be moved from the rest position to the writing position; which by means of two motors corresponding to the symbols to be drawn, can be moved in two coordinate directions, whereby at least the writing part can be attached to the drawing head of the drafting machine.

2. Brief Description of the Prior Art:

With a known lettering device of this type (DE - PS No. 12 41 312) the writing part is arranged on a guide track and is movable by a threaded spindle driven by one of the motors along this guide track. The writing arm located on the writing part is rotatable by means of another motor around an axis so that the writing pen moves along a circular, arched path. By guiding the writing part along the guide track and by superimposing a swivel movement of the writing arm and, thereby, the writing pen over this movement, the desired symbols can be drawn on the writing surface.

With this known lettering device, in which the movement of the writing part relative to the drawing surface consists of a complicated combination of polar coordinates, not only the writing arm, but also the writing arm drive motor is located on the writing part which moves along the guide track. Thus, the writing part has considerable weight which must be moved back and forth along the guide track when drawing the symbols, thereby considerably restricting the writing speed, since at a high writing speed the mass being moved back and forth cannot be stopped quickly enough.

With a second known lettering device of this type (U.S. Pat. No. 4,197,550 or DE OS 27 24 855) the writing part attached to the drawing head contains two working cylinders which attach to the writing pen and whose length is adjustable in each case by a motor attached to a base plate at the end opposite the writing pen. These base plates which also support each of the associated drive motors are swivellingly attached to the drawing part.

Through controlled changes of the lengths of both working cylinders, by means of motors, the desired symbols can be drawn. However, the resulting work area is relatively small and, in addition, each particular adjustment in the length of the working cylinders for drawing any given symbol depends on which area of the working field is being drawn on. In order to at least partially eliminate the difficulty, an additional drive is provided in this second, known lettering device, wherein the entire writing part can be lengthwise adjusted relative to the writing field to be produced, so that this lettering device necessitates three motors and drives.

A further disadvantage with this second known lettering device comprises the fact that the base plate, supporting the ends of the working cylinders opposite the writing pen, also must support the associated motor for driving the working cylinders. As a result, this entire drive arrangement must be swiveled, along with the base plate, when the base plate is swiveled. This leads to the limitations, as set out hereinbefore, in the writing speed.

A third numerically controlled writing machine is also already known (DE - AS No. 12 95 858) in which the writing pen is movably attached to a traveler which moves along cartesian coordinates, which in addition supports a drive motor and a gear for moving the traveler in a coordinate direction. This traveler is located on a transverse support which can be moved in the direction of the other coordinate and on which, in addition to the traveler, a gear and a drive motor for moving the transverse support are attached.

With this known drawing machine not only lettering, but also numerically controlled drawings are produced and it is clear that the drawing speed has to be relatively low. On the one hand, the traveler with the various construction elements, and on the other hand, an even stronger transverse support supports the traveler, and further construction elements, must have a relatively large mass which is very difficult to accelerate and slow down.

Thus, it is the object of the invention to produce a lettering device which, as a result of the particularly light execution of the movable parts, allows high drawing speed.

To obtain this object, a lettering device of the type mentioned at the outset is produced according to the following invention, wherein the motors for moving the writing tip along cartesian coordinates are stationarily attached in relation to each other and the writing arm which holds the writing pen is attached so that it moves in the direction of one coordinate on a first guide track movable in a direction of the other coordinate by a first motor and is movable in the direction of the other coordinate on a second guide track movable in a direction of a coordinate by a second motor, wherein both guide tracks extend, in the area where they cross, preferably through a slide bearing body, to which the writing arm is attached.

SUMMARY OF THE INVENTION

With the writing device according to the present invention, the writing arm drive motors are stationarily attached relative to one another and are not moved when the writing arm is moved. The movement of the writing arm takes place solely through corresponding movement of both guide tracks. Hence, only the weight of the guide tracks and the weight of the writing arm, including the writing pen, determines, essentially, the mass of the moving parts, i.e., the writing arm can be moved with relatively high writing speed due to the low mass which must be moved.

A further essential advantage of the lettering device according to the invention consists in the fact that the writing arm is moved along cartesian coordinates. Hence, without altering the path along which the intersection point of the two guide tracks move, and thereby the form of the drive movement of both motors, a given symbol can be drawn at any location on the writing field which is defined outside of an upper longitudinal edge of the writing part, as further will be discussed hereinafter. Therefore, the length of the writing field is only limited by the length of the movement path of the writing arm in a coordinate direction, parallel to the longitudinal extension of the writing field. In addition, several symbols can be written below each other onto the writing field without necessitating a change in the position of the writing device. This is possible because the writing pen can be moved over the drawing surface (to the extent of the corresponding length of the movement path) in the coordinate direction which runs transversely to the longitudinal extension of the writing field which is located external to a longitudinal edge of the housing around the writing part.

In order to insure that the guide tracks and the writing arm move as accurately as possible, in correspondence with the drive movements caused by the motors, the guide tracks preferably have guide bearings on both ends which engage stationary roller rails. Further, and preferably, both guide bearings of each of the guide tracks is synchronistically driven, so that there is no possibility of tipping of the guide tracks, relative to their respective transverse of longitudinal extension.

The writing arm can extend from a proximate end attached to the slide bearing body to a distal end where the pen is mounted, with the arm portion therebetween extending through the bearing body of a guide bearing, which engages the roller rail that extends longitudinally to the transverse extension of the writing arm and adjacent to the writing pen. Hence, this guide bearing supports the writing arm, guide and mounting.

Lowering the writing pen into writing position, and raising it into the rest position, can be accomplished very simply by means of a lowering track which extends parallel to one of the guide tracks, and at a right angle to the writing arm. The lowering track preferably can be swiveled, by means of a solenoid, so that the writing arm, and thereby the writing pen, can be raised and lowered to any possible position along its movement path transverse to the longitudinal extension of the writing arm.

The invention is explained in greater detail hereinbelow, with reference to contain schematically simplified embodiments shown in the accompanying drawings.

DETAILED DESCRIPTION OF THE PREFERRED EMBODIMENT

Figure 1:
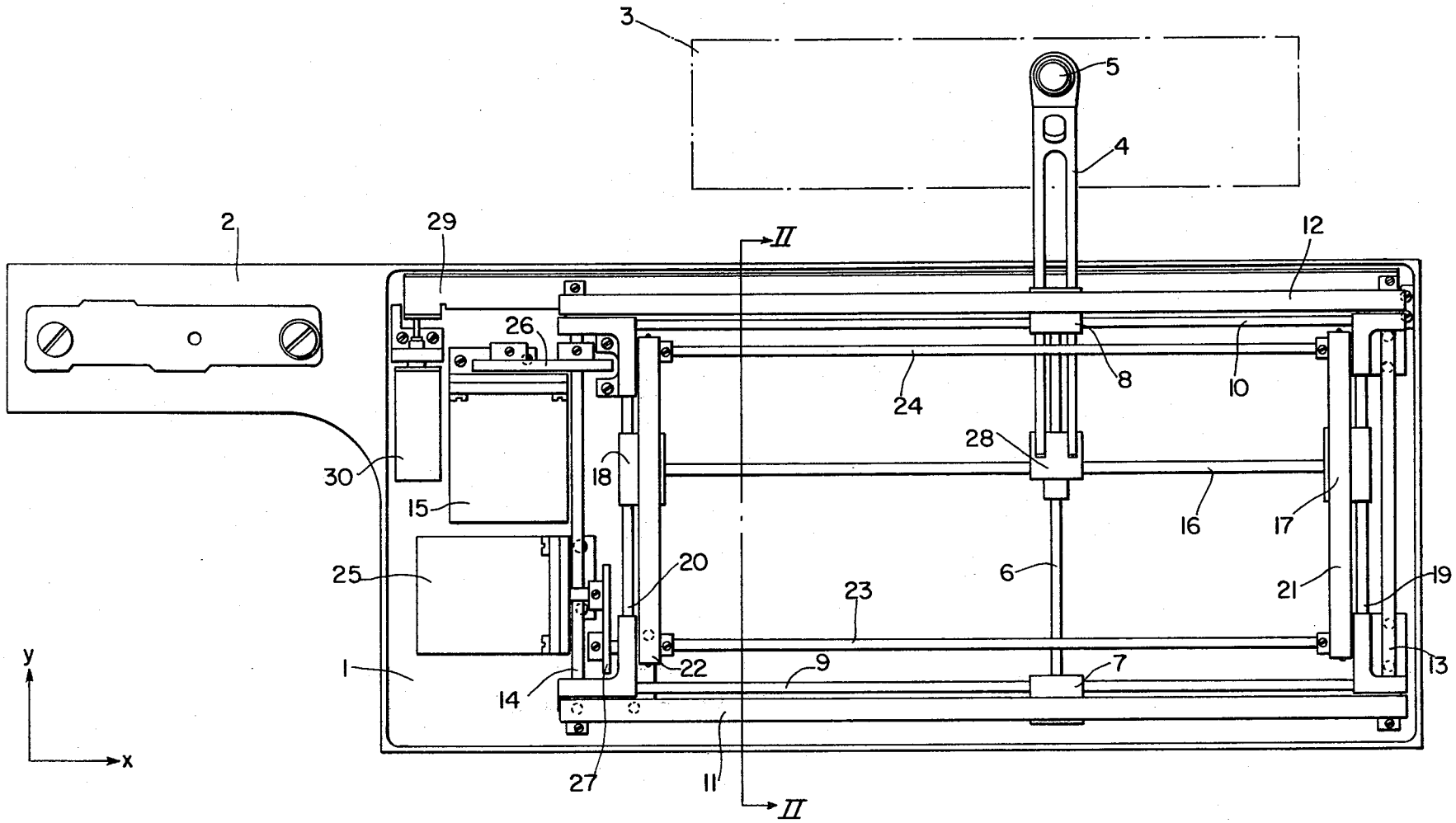
FIG. 1 is a top view of a preferred embodiment lettering device, capable of being attached to a drawing head, whereby a covering plate, which conventionally supports the bank of keys, is not shown.
Figure 2:
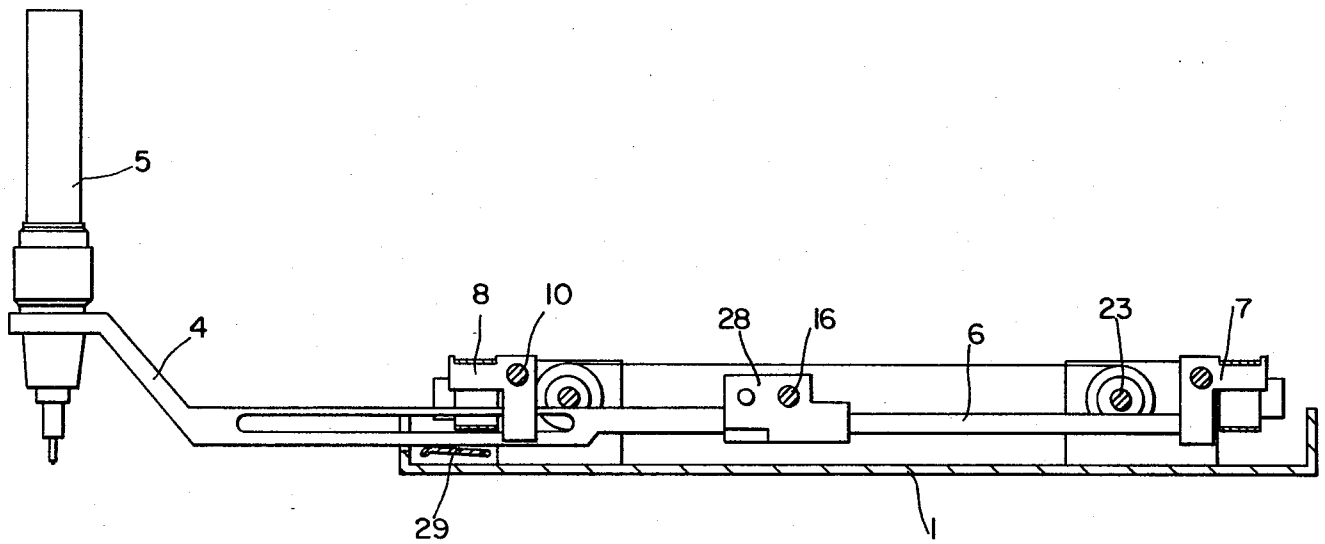
FIG. 2 shows a section along the line II—II of FIG. 1.

FIGS. 1 and 2 show essentially the writing position of a lettering device to comprise a base plate 1, to the side of which an attachment area 2 is located for connecting the drawing head of a drawing machine. Roller rails, 9, 10, are attached to the base plate and extend in the longitudinal or the direction of the y-coordinates (per the referenced coordinate system, shown). Roller rails 19, 20 extend in the transverse or x-coordinate direction, and are also attached to the base plate. Located between the roller rails 9, 10, is a guide rail, 6, whose ends exhibit guide bearings, 7, 8 in sliding contact with the roller rails 9 and 10. Correspondingly, between the roller rails 19 and 20, a guide rail 16 is provided, with guide bearings 17 and 18 on its ends in sliding contact with the roller rails 19, 20. A slide bearing body 28 is provided in the area of intersection of the guide rails 6, 16 through which guide rail 6 as well as guide rail 16 extend. Writing arm 4 is attached at its proximate end to the slide bearing body 28. This writing arm runs essentially parallel to guide rail 6 as well as slidingly through the body of the guide bearing 8. It extends as illustrated, upward above the base plate 1 and beyond it. The writing arm has a distal end configured so that a tube writer tip 5 can be screwed into its free end area. Hence, is is apparent that any desired writing arm 4 (and writing tip 5) movement can be achieved by combining the movements of guide rails 6 and 16 in x- and y-directions. Therefore, this mounting of the writing arm 4 (and with it the tube writer 5) allows symbols to be drawn. With the base plate in a stationary position as shown in FIG. 1, above the longitudinally extending upper edge there is a rectangular zone defined within a writing field 3, whose maximum length and maximum height are defined by the measurements of guide rail 6. Thus, only relatively small masses are moved relative to the base plate 1, namely, the guide rails 6 and 16 including their guide bearings 7, 8 and 17, 18, the slide bearing body 28, the writing arm 4 and the tube writer tip 5 which forms the writing pen. Accordingly, with motorized drive of these parts, as will be described hereinbelow, high drawing speeds can be reached.

A motor 15 to move the guide rail 6 in the x-direction, and a motor 25 to move the guide rail 16 in the y-direction, are attached to the base plate 1. Motor 15 drives a shaft 14, which extends parallel to the guide rail 6 by means of a gear train 26. Said shaft 14 is interconnected, to a shaft 13, which is situated adjacent to the guide bearing 17, drives 11, 12 which run parallel to shaft 10 and connect to guide bearings 7 and 8. This makes it possible for guide bearings 7 and 8 to move back and forth in x-direction at exactly the same speed, with guide rail 6 being constantly parallel to the shafts 13 and 14.

Correspondingly the motor 25 drives a shaft 23 disposed parallel to guide rail 16 by means of a gear 27. Said shaft 23 is interconnected to shaft 24, that is disposed parallel to shaft 23 by means of drives 21, 22, e.g., toothed belts, and each drive connects to guide bearings 17 and 18 so that guide rail 16 is also held parallel to shaft 23 as it is moved in the y-direction.

Control of motors 15 and 25 does not need to be described in detail since such controls are well known, for example, in digital x-y potters. It should be noted, however, that the required movement of the slide bearing body 28, and the tube writer tip 5 associated therewith, for individual symbols to be drawn can be previously stored and simply retrieved by activating an associated key (not shown), so that motors 15 and 25 are activated in dependence on the stored movement commands.

On the base plate 1, between the guide bearing 8 and the tube writer tips, a lowering rail 29 is attached which extends parallel to the guide rail 16. FIG. 1 shows one end of this lowering rail attached to the armature of a solenoid 30, in turn attached to the base plate 1. Hence, by correspondingly activating and deactivating the solenoid the lowering rail 29 can be swung to a raised position in which it is in contact with the botton side of the writing arm 4 and lifts the same so that the tube writer tip 5 can either be above the writing surface, in its rest position or in a lowered position in which the tube writer tip 5 is in the drawing position, i.e., the writing tube lies on the drawing surface, as shown in FIG. 2.

A keyboard (not illustrated) with a corresponding housing is preferably set as a cover upon the base plate 1 shown in FIGS. 1 and 2, so that the keys needed to write the symbols being directly adjacent to the tube writer tip 5 and movable with the drawing head. The keyboard is to be conventionally connected to a processing unit, (not shown) as by a flexible cable which need not be attached to the drawing head, and which evaluates the commands elicited by activation of each individual key and, conventionally relays y-control commands to the motors 15 and 25, as well as to the solenoid 30. Such conventional electronic processing x-y motor commands form no part of the present invention, and further illustration is not considered necessary to understand the present invention for an improved drawing head apparatus, which is to be defined by the scope of the appended claims.

I claim:

1. In a program-controlled lettering and drawing device of the type having a control unit connected by an electrical cable to an operating unit which comprises a housing having a keyboard for choosing the symbols to be written and a writing part, the improvement wherein said writing part comprises a writing pen which extends exteriorly of said housing and is movable by a writing arm over a space external to a longitudinal edge of said housing and also between a rest position and a writing position, wherein said writing part further comprises motor means mounted inside said housing selectively to move said pen over said space in longitudinal and transverse coordinate directions to correspond to symbols there to be drawn, wherein said housing further comprises means for an attachment to the symbol head of a drafting machine, and said motor means further comprises first and second motors (15, 25), which are arranged stationary, relative to each other, and respectively drivingly are connected to crossing longitudinal and transverse guide tracks (6, 16) which extend through a slide bearing body (28) which joins said two guide tracks in the area where they cross, wherein said writing arm (4) is attached at a proximate end to said slide bearing body and extends transversely to a distal end where said writing pen (5) is held, said arm being movable transversely by said second motor (25) along a first movable guide track (6) that itself is movable in the longitudinal coordinate direction by said first motor (15), wherein said arm is movable longitudinally by said first motor (15) over a second guide track (16) that itself is movable in the transverse direction by said second motor (25), wherein further said arm is supported by and transversely slideable within a guide bearing (8) that is slideably engaged for longitudinal movement upon a slide rail (10) which is situated longitudinally with respect to the transverse extension of the writing arm (4), wherein said guide bearing is disposed between the proximate and distal ends of said arm.

2. A lettering device according to claim 1 wherein each of said guide tracks (6, 16) has a guide bearing (7, 8; 17, 18), at each of their respective ends and said guide bearings are in sliding contact with stationary guide rails (9, 10; 19, 20).

3. A lettering device according to claim 2 , wherein both guide bearings (7, 8; 17, 18) upon the ends of the guide tracks (6, 16) can be synchronously driven.

4. A lettering device according to either of claims 2 or 3, wherein the writing arm (4) extends for longitudinal movement within a bearing body of a guide bearing (8) that is engaged for said longitudinal movement over a slide rail (10) which is situated longitudinally to the transverse extension of the writing arm (4) and said guide bearing being disposed between the proximate and distal ends of said arm.

5. A lettering device according to claim 1, characterized by a lowering track (29) which runs parallel to said longitudinal guide track (16) and and is proximate to the distal end of said writing arm (4) said track being operable to engage said writing arm distal end and hold the writing pen (5) in a raised position in its normal, rest position.

6. A lettering device according to claim 5, wherein the lowering track (29) is activated by a solenoid (30).

* * * * *